United States Patent [19]

Sumida

[11] 4,073,349

[45] Feb. 14, 1978

[54] BALANCED RECIPROCATING TOOL DRIVEN BY ROTARY MOTION

[75] Inventor: Kunio A. Sumida, Los Angeles, Calif.

[73] Assignees: Robert H. Siegel; Maurice Albin, Chicago, Ill. ; as coexecutors of the estate of Leonard V. Shapiro, deceased

[21] Appl. No.: 647,338

[22] Filed: Jan. 8, 1976

Related U.S. Application Data

[63] Continuation of Ser. No. 461,519, April 17, 1974, abandoned, which is a continuation-in-part of Ser. No. 261,096, June 8, 1972, abandoned.

[51] Int. Cl.[2] ..... B23B 17/00

[52] U.S. Cl. ..... 173/59; 51/170 TL; 173/169; 74/42

[58] Field of Search ..... 51/170 TL, 170 MT; 308/DIG. 1; 74/42; 173/59, 170, 169

[56] References Cited

U.S. PATENT DOCUMENTS

| | | | |
|---|---|---|---|
| 1,818,361 | 8/1931 | Schwabe, Jr. | 51/170 TL |
| 2,661,812 | 9/1954 | Champayne | 51/170 TL |
| 2,795,901 | 6/1957 | Mosbacher | 51/170 TL |
| 3,214,823 | 11/1965 | Hendrickson | 51/170 TL |
| 3,225,801 | 12/1965 | Dunn et al. | 308/DIG. 1 |
| 3,286,535 | 11/1966 | Schradder | 74/44 |
| 3,793,781 | 2/1974 | Hutchins | 51/170 TL |

FOREIGN PATENT DOCUMENTS

| | | | |
|---|---|---|---|
| 514,979 | 11/1952 | Belgium | 51/170.3 |

*Primary Examiner*—Ernest R. Purser
*Assistant Examiner*—William F. Pate, III
*Attorney, Agent, or Firm*—Ellsworth R. Roston

[57] ABSTRACT

A reciprocating tool, such as a sander, which may be driven by a rotary pneumatic motor via an eccentric connection with a gear train. In order to balance the dynamic forces generated by the reciprocating tool element, a weight may be properly positioned within the tool housing and driven by a similar eccentric connection to a gear train. Proper coordination of the gear train will result in the movement of the tool element and the weight in opposite directions at any given instant, thereby increasing the operator's ability to maintain the tool in a desired path of movement.

25 Claims, 4 Drawing Figures

BALANCED RECIPROCATING TOOL DRIVEN BY ROTARY MOTION

This application is a continuation of application Ser. No. 461,519, filed Apr. 17, 1974, now abandoned, which, in turn, was a continuation-in-part of application Ser. No. 261,096, filed on June 8, 1972, abandoned.

BACKGROUND OF THE INVENTION

Most of the presently available reciprocating pneumatically driven hand tools, such as saber saws, sanders, etc., are driven by means of air-actuated pistons. Although in many cases such drive systems are entirely satisfactory for the operation to be accomplished, they are generally unsuitable when the tool is to be utilized in a "heavy duty" application, such as in a professional shop.

When a heavy load is placed upon a piston-driven tool, such as by passing down hard on a reciprocating sander, the resistance to reciprocation is transmitted back to the piston and its throw and/or speed or travel is reduced accordingly.

Since the effectiveness of most reciprocating hand tools such as saws and sanders is measured by the distance that the material-working tool element travels per unit of time, i.e., the number of sawteeth which cross the line of cutting or the square inches of sandpaper which cross any arbitrary line on the material being sanded, it is quite apparent to those skilled in the art that the reduction of piston throw in such tools adversely affects the efficiency of the tool. As a result, the time and effort required to accomplish any specified operation with such a tool is increased more and more as greater force is exerted on the tool to press it against the workpiece. Although an optimum level of force versus time may be achieved, it is quite clear that if that optimum level is exceeded, the excessive force must be applied over a greater length of time in order to accomplish a desired result.

In the past, it has been believed to be impractical to drive such tools with rotary motors for two reasons. First, it has been thought that relatively complex linkages must be developed to convert the rotary motion into reciprocal motion. Secondly, reciprocation of the tool element per se generates dynamic forces during operation of the tool which, in the past, have been very suitably counteracted by the inertial weight and force of the reciprocating piston. In other words, the prior art machines have been developed in such a way that the piston weight would approximately equal the weight of the reciprocating tool element. The tool element is then connected to the piston by a linkage which causes the tool element to reciprocate in the opposite direction as the piston element, at any given instant.

Since pneumatically driven piston-actuated reciprocating tools thus are adversely affected by the imposition of a load thereon, such tools have failed to achieve a widespread usage as might otherwise be expected utilizing a power source as efficient as compressed air.

Pneumatically driven tools are not subject, under normal circumstances, to the generation of electrical potential between the tool body or housing and the surface upon which an operator is standing. As a result of this advantage of pneumatic tools, it is desirable to produce a pneumatically operated tool which is not subject to efficiency reduction as a result of a diminished throw of a piston when a load is placed on the tool.

SUMMARY OF THE INVENTION

The present invention relates to a pneumatically operated hand tool machine in which the tool stroke is not reduced by the imposition of force between the tool and the workpiece. More specifically, the invention relates to such a hand tool in which a reciprocating tool may be driven, through a simple linkage, by a rotary motor which may be pneumatically driven.

Dynamic forces generated by the reciprocation of the tool element may be substantially balanced by a duplication of a portion of the rotary-to-reciprocating linkage which then acts to reciprocate a weight which is substantially equal to that of the reciprocating tool.

The resulting machine allows an operator to utilize the tool with whatever force he may wish in bearing down upon the workpiece. Although the imposition of such stress or force may slow the speed of the tool slightly, it will not reduce the throw of the tool element since the rotary-to-reciprocating linkage is incapable of absorbing any substantial energy and the throw length must therefore be constant.

In one exemplary embodiment of the invention, a sander having a reciprocable shoe, to which sandpaper may be suitably attached, may be driven by a link eccentrically connected to a rotatable gear. The gear may be rotated by a pinion mounted on the rotor shaft of a rotary motor. Thus, when the motor is actuated, the pinion will cause rotation of the gear. In turn, the eccentric connection between the gear and the sander shoe link will cause reciprocation of the shoe under the guidance of suitable track elements attached to the housing.

Simultaneously, a second gear may be driven by the pinion in the same direction. A second link may be eccentrically connected to the second gear and pivotally connected to a reciprocatable weight which is guided in its movement along a second track system in the housing. Consequently, rotation of the gears in the same direction will cause simultaneous reciprocation of the sander shoe and the weight in opposite directions. Therefore, the dynamic forces generated by the reciprocation of the sander shoe will be balanced by the reciprocation of the weight. As a result, an operator can operate the tool at any desired rate of speed without experiencing forces which would tend to wrench the tool from his hands or chatter against the workpiece.

If the tool is pneumatically driven, air exhausting from the motor may be controlledly passed between the housing and the sander shoe. This feature is highly advantageous because the air will create a "bearing" between the tool and the housing to reduce wear. Further, the air escaping from the housing will tend to blow foreign matter away from the tool, thereby obviating entry of foreign matter into the housing and continuously cleaning the workpiece surface. Additionally and of even further importance, the escaping air, if passed over the tool element itself, will cool the tool element and may thus prolong its useful life. In this regard, escape of the air between the tool element and the housing will prevent heat transfer between the tool element and the housing, thereby improving the operator's comfort since the housing will remain cooler.

The use of gearing to drive the tool and the balancing weight also provides the possibility of integrating a simple gear reduction system directly into the drive train. Since rotary pneumatic motors have a tendency to try to rotate at the lineal speed of the air expanding thereagainst, a non-speed reduced system will attempt to reciprocate the tool and balancing weight at a velocity which will quickly destroy the mechanism and its bearings. Therefore, if desired, the drive gearing may be suitably designed to both reciprocate the tooling and reduce the motor output speed to an acceptable level.

In another embodiment of the invention, the counterweight is slightly offset with respect to the shoe. For example, when the link driving the shoe lies in a direction corresponding to the direction of reciprocation of the shoe, the link driving the counterweight is rotated through a slight angle with respect to this direction. This insures that the sander will start to operate even through the sander may have previously stopped with the link driving the weight disposed in a direction substantially parallel to the sides of the housing.

Although, in the following description and the drawings, the invention is illustrated as being embodied in a sander, it will be realized by those skilled in the art that the inventive concepts may be utilized in a wide variety of reciprocatable tools without loss of any of the advantages inherent in the invention. Various additional objects and advantages of the present invention will become apparent to those skilled in the art upon review of the following Detailed Description, taken together with the drawings. Those objects and advantages will also be inherent in a wide variety of additional embodiments without exceeding the protected scope of the invention as defined in the claims.

DETAILED DESCRIPTION

Figure 1:
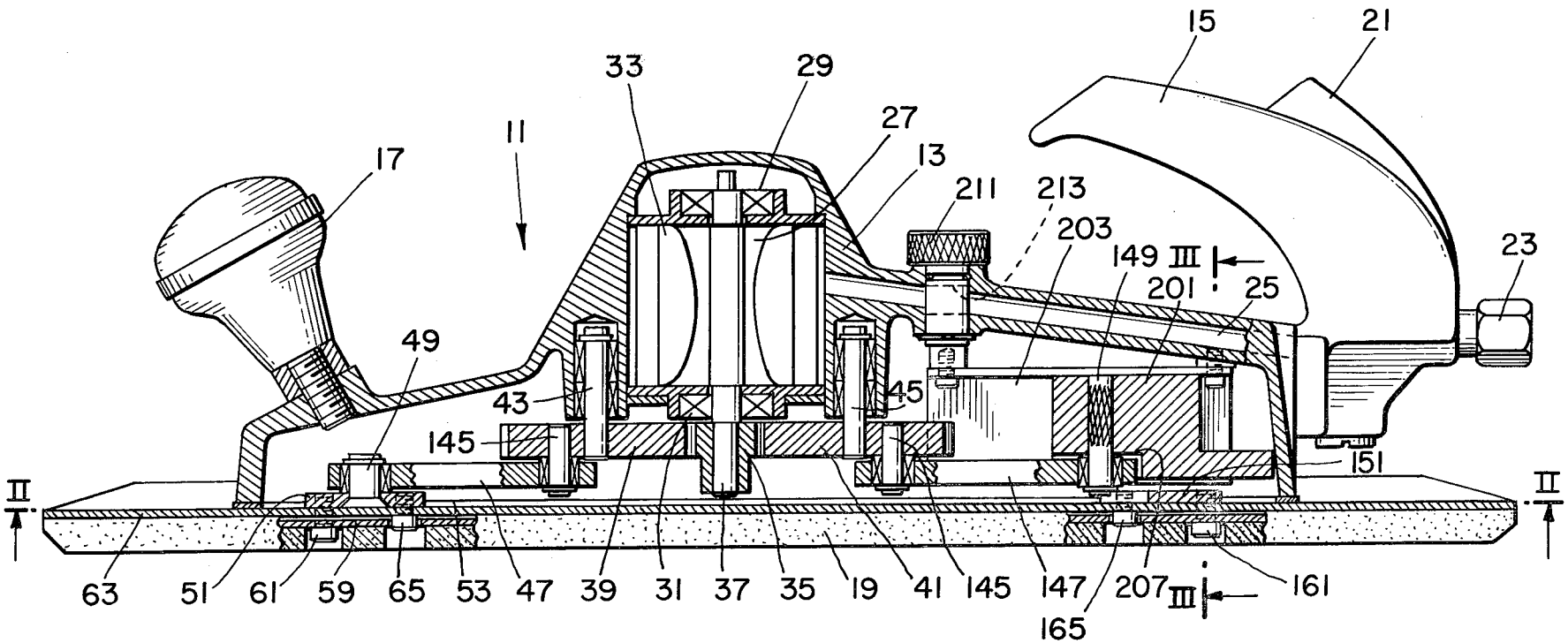
FIG. 1 comprises a side elevation, partly in cross section along the longitudinal axis of the tool, of a reciprocatable sander which embodies the concepts of the present invention.

In FIG. 1, a sander, generally designated at 11, may comprise a body or housing 13 having an integral or suitably attached first handle 15 and a second handle 17. A sander shoe 19 may be suitably attached, in a manner to be described, for reciprocation along the bottom of the housing 13 so that sandpaper (not shown), which may be suitably attached thereto, can be properly moved across the surface of a workpiece (not shown).

If desired, a trigger member 21 may be suitably located in the handle 15 for actuation by the heel of the operator's hand so as to admit air through a coupling 23 from a compressor or other device (not shown) to a passageway 25 in the housing. The trigger 21 may be utilized to actuate any well-known valve which may be situated within the handle or the housing such as a ball valve which is spring-pressed against a valve seat, past which air must travel to reach the passageway 25.

A rotary motor 27 may be mounted in the housing 13, for example, by means of bearings 29 and 31, so that the motor may be rotated by air which, after passing through the passage 25, impinges upon blades 33 of the motor. In turn, a pinion gear 35, which may be mounted on an extension 37 of the central shaft of the motor rotor, may be driven as the motor is rotated.

Figure 2:
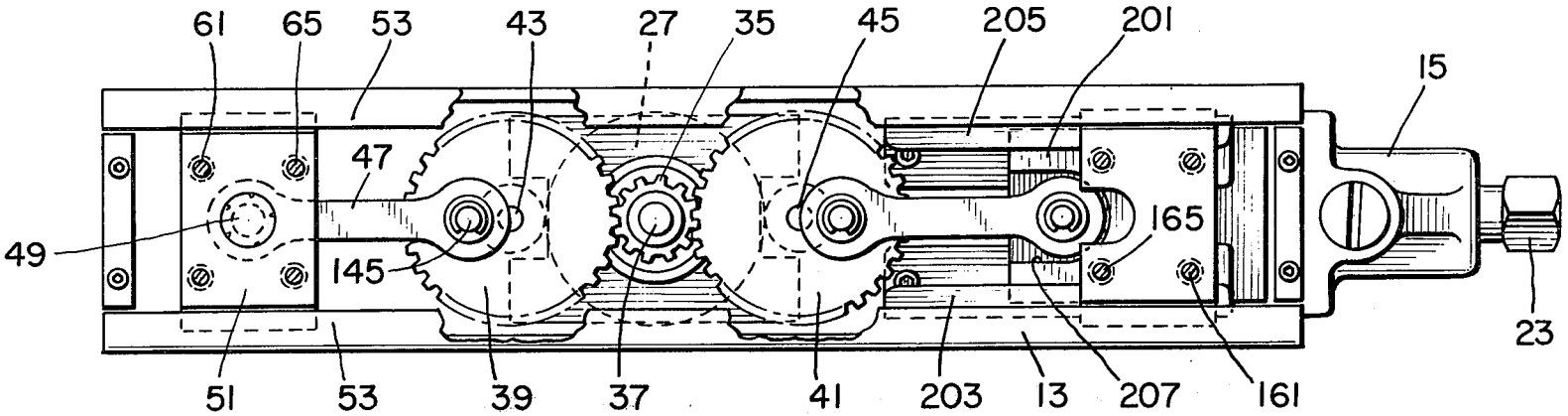
FIG. 2 comprises a bottom plan view of the tool shown in FIG. 1, with various elements broken away for clarity and taken along a link II—II thereof.

A first drive gear 39 and a second drive gear 41 may be fixedly mounted on axles or pins 43, 45, respectively, which axles or pins are suitably mounted within bearings for rotation. Thus, as the motor is driven by the incoming air, the pinion gear 35 will cause the rotation of the drive gears 39 and 41. Reference to FIG. 2 will clearly reveal to those skilled in the art that rotation of the pinion 35 will cause the drive gears 39 and 41 to rotate in the same direction for a purpose to be described. Thus, the motor and gear train comprise a very compact system. Further, the gear ratio between pinion 35 and the drive gears can be designed to allow the gears to simultaneously serve as a speed reduction system to reduce the output speed of a motor 27 to an acceptable level for reciprocation of the tooling 19 and a balancing system to be described. In this manner, the compactness of the system is preserved while the drive power is properly harnessed so that the tool will not destroy itself by excessive speed.

A connector pin 46 may be fixedly or pivotably mounted on the forward drive gear 39 and rotatably mounted in a forward or sander link 47 so that, as the gear 39 rotates, the rear end of the link 47 will be driven in a circular motion by the pin 45 which will move in a circle about the axis of axle 43. The forward end of the link 47 may be pivotally attached to a forward shoe pin 49 which, in turn, may be fixedly or pivotably attached to a forward drive plate 51. Thus, as the rear end of the link 47 is driven in a circle about the axis of axle 43, the forward end of the link will cause the drive plate 51 to reciprocate along tracks 53 situated at the lower portion of the housing 13 (see FIG. 2).

The sander shoe 19 may be suitably bonded to a closure plate 59 for reciprocation therewith and the forward end of the shoe and plate 59 may be suitably attached to the drive plate 51 by any desired means such as bolts 61. The lower end of the housing, on the other hand, may be enclosed by a reciprocatable cover plate 63 which is suitably attached to the drive plate 51 both by the bolts 61 and by bolts 65. It will be realized by those skilled in the art that, since bolts 65 do not serve to hold the sander shoe to the drive plate 51, the sander shoe can be detached from the drive plate 51 merely by removing the bolts 61. This will allow the sander shoe to be replaced without requiring the removal of the cover plate 63 and thus prevent dirt and other foreign matter from getting into the housing 13 where it might cause scoring of the various bearings, etc.

Figure 3:
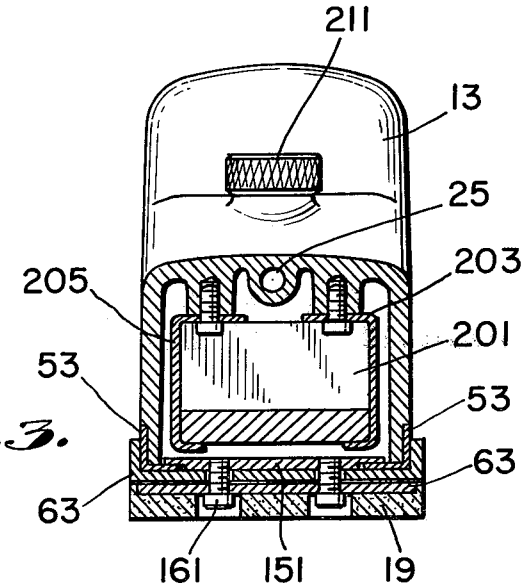
FIG. 3 comprises a cross sectional plan view of a portion of the tool as seen along the line III—III of FIG. 1.

At the rear of the housing, a link 147 may be pivotally attached to a pin 145 which may be suitably connected to the drive gear 41, causing the link 147 to be driven in much the same manner as the link 47 is driven. The rear end of the link 147, however, may be pivotally attached to a pin 149 fixed within a weight 201. As seen in FIG. 3, the weight 201 may be reciprocatably mounted in tracks 203, 205 so that when the drive gear 41 actuates the link 147, weight 201 will be reciprocated within the tracks. Recalling that the drive 39 and 41 rotate in the same direction, it will be realized that as the sander shoe is moving toward the front of the tool, the weight 201 will be moving toward the rear and vice versa. Consequently, if the weight is selected so as to have approximately the same mass as that structure which is moving in the opposite direction, it will tend to effectively balance the inertial forces generated by the movement of the sander shoe 19 and its related structure.

Therefore, an operator holding the tool will not experience a tendency for the tool to be ripped from his hand and will be able to position it very accurately without fear of the tool jumping around or vibrating on the workpiece. If desired, a suitable arcuate slot 207 may be machined into the bottom of the weight 201 (FIG. 2) so that the link 147 and pin 149 will not obstruct the free movement of the weight. In any event however, the tool element and the weight will thus be caused to reciprocate in opposite directions and the desired result will be achieved.

In order to attach the rear end of the sander shoe 19 and housing cover plate 63 to the housing, a reciprocating holding plate 151 may be suitably mounted on the rear ends of the tracks 53. The rear end of shoe 19 may be attached to the plate 151 by means of bolts 161 which pass through and hold the shoe and the plate 63. Similarly, to the front end, a second pair of bolts 165 may be utilized to hold only the housing cover plate 63 to the holding plate 151. Consequently, when the sander shoe is to be replaced, only the bolts 61 and 161 need to be removed. The bolts 65 and 165, which need not be removed, will fixedly hold the reciprocatable cover plate 63 to the drive plate 51 and the holding plate 151.

In operation, when the operator presses the trigger 21, air admitted through the passage 25 may be adjusted in volume by means of a rotatable valve 211 having a radial passage 213 therein which may be aligned with the passage 25. In the position illustrated in FIG. 1, a maximum volume of air will travel through the passage 25 to the motor 27. However, when the valve 211 is rotated so that the passage 213 becomes misaligned relative to the axis of the passage 25, a reduced volume of air will be transmitted to the motor. In this manner, the operator can effectively control the speed of the sander merely by adjusting the position of the valve 211. It will be realized by those skilled in the art that this is much easier than attempting to control the position of trigger 21 since the operator's instinct will be to grip the handles 15 and 17 firmly so as to accurately control the position of the sander.

As the rotor of the motor 27 is thus rotated, the pinion gear 35 will drive the drive gears 39 and 41 in the same direction, thereby causing the above-described motion of the links 47 and 147. Link 47 will cause the reciprocation of the sander shoe 19 and housing cover plate 63 via the drive plate 51. At the same time, the rear end of the sander shoe and cover plate will be held against the housing by means of the holding plate 151.

As the link 147 is actuated, it will cause reciprocation of the weight 201 and, since the drive gears 39 and 41 are rotating in the same direction, the sander shoe and cover plate will always move in the opposite direction as the weight 201. Thus, the sander will be effectively dynamically balanced.

As the air exhausts from the motor 27 after having expanded against the the blades 33, it will create a relative pressure within the housing 13 which is greater than the ambient pressure on the exterior thereof. The air within the housing will therefore create an air bearing between the tracks 53 and the cover plate 63 (FIG. 3), tending to drive those elements apart and thereby reduce wear which might otherwise occur between them. This air bearing tends to position the reciprocating tool 19 laterally relative to the housing and therefore limits any tendency for the reciprocating tool to sway laterally. Furthermore, it tends to position the drive plate 51 and the holding plate 151 laterally relative to the tracks 53 so that the plates 51 and 151 will not bind relative to the tracks when the plates 51 and 151 and the tool 19 and the weight 201 reciprocate relative to the housing 13.

Simultaneously, the air will produce a second useful function in that it will blow all of the workpiece particles as well as other foreign matter away from the tool and the area being worked. Consequently, the particles will not get into the tool housing and the work area will be constantly cleansed so that the operator's view of the area will not be obstructed.

Additionally, the air escaping from the housing past the tool or sander shoe 19, will expand somewhat as it does so, thereby causing increased cooling of the tool with a consequent extension of its useful life. At the same time, the air will create a barrier which will inhibit transfer of heat from the tool to the housing. Since the housing will therefore remain cool, the operator will not be discomforted.

Thus, with this invention, a reciprocatable tool may be driven by a rotary motor in such a fashion that the tool is effectively dynamically balanced. Since the motor is rotatably driven, as opposed to being driven by a piston for example, if the tool operator tends to bear down on the workpiece with the tool, the increased loading between the tool and the workpiece will not cause a reduced stroke of the tool across the workpiece. Since the effectiveness of the tool is determined by the area of the tool which crosses any given line on the workpiece, extra force exerted by the operator will not drastically reduce tool efficiency even if it becomes so great as to reduce tool speed. In other words, with piston-type reciprocatable tools, excessive force by the operator will reduce the throw of the piston and therefore will reduce the travel of the tool. Rotary driving of the tool, as exemplified in the description of this sander, will prevent the travel of the tool from being decreased since the linkage structure 47, 147 will always cause the sander shoe and weight to travel the same distance, regardless of tool speed. Further, the use of the gearing as a speed reducer will result in increased reciprocating power being delivered to the machine, thereby increasing its "heavy duty" utility.

Figure 4:
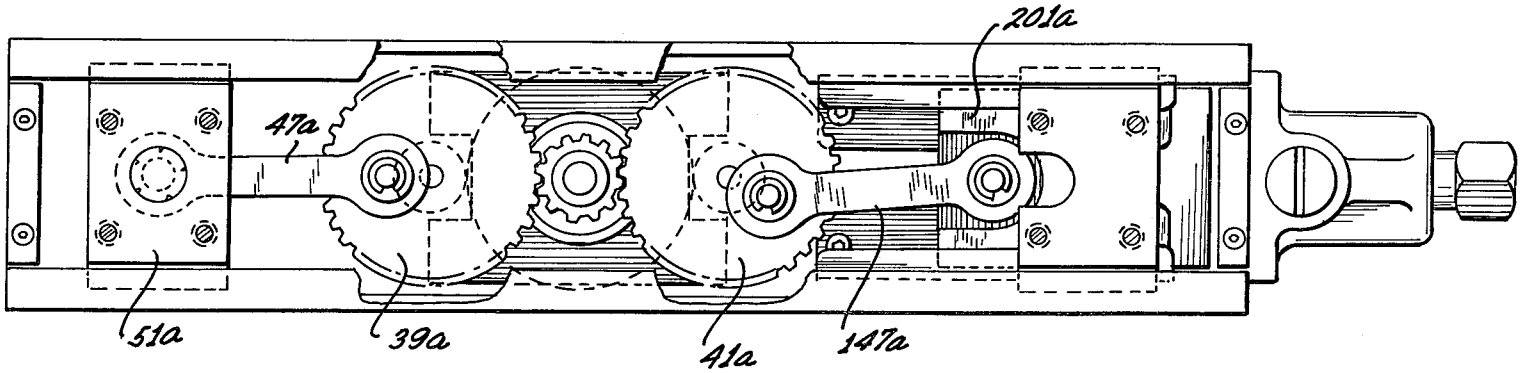
FIG. 4 is a bottom plan view similar to that shown in FIG. 2 but showing another embodiment of the invention.

In the embodiment shown in FIG. 4, members similar to those in FIGS. 1 to 3, inclusive, are given similar numbers except that the suffix "*a*" follows the numbers in FIG. 4. The embodiment shown in FIG. 4 is similar to the embodiment shown in FIGS. 1 to 3, inclusive, except that the link **147*a* is slightly offset angularly with respect to the link 47. For example, if the gears 39*a* and 41*a* are considered to have 41 teeth, the link 147*a* may be offset by an angular distance of approximately 3 teeth from the link 47*a*. Thus, when the link 47*a* is disposed parallel to the side walls of the housing 13, the link 147*a* is disposed at an angle of approximately 4° to the side walls of the housing. By providing this offset between the links 47*a* and 147*a*, a slight imbalance is created between the drive shoe 51*a* and the counterweight 201*a*. This slight imbalance prevents the sander from becoming stalled when the sander stops with links 47*a* and 147*a*** disposed in an aligned relationship. By providing this slight imbalance, the sander can be started again without imposing external forces on the sander such as banging the sander.

It will now be realized by those skilled in the art that the above description is set forth by way of example only. Many other modes and embodiments of the invention will become known to those skilled in the art without exceeding the scope of this invention. For example, the reciprocatable tool could be driven by a plate at the rear of the housing and the weight could be positioned at the forward part of the housing. Alternatively, with simple design changes the weight and tool drive structure could be positioned at the same end of the housing by lengthening one of the links 47 and 147 and extending it in the opposite direction from that shown.

Further, the invention is certainly not limited to a sander since it is equally applicable to any reciprocatable tool such as a saber saw, reciprocatable power-driven file, etc.

Thus, it will be realized by those skilled in the art that the instant invention presents a true advance in the art since it presents a relatively compact reciprocatable hand tool machine driven by a rotatable motor, which may be pneumatic. This machine may be effectively dynamically balanced so that the tool may be accurately positioned and controlled by an operator.

These and other modes of this invention are defined not by the above description, but rather by the following claims.

I claim:

1. A reciprocatable hand tool machine comprising
a housing,
a rotary motor mounted in said housing,
means for actuating said rotary motor,
first drive means in said housing, said first drive means including a first gear driven by said rotary motor,
second drive means in said housing, said second drive means including a second gear driven by said first gear in a first rotary direction and a third gear driven by said first gear in the same rotary direction,
a work-operating tool mounted on said housing for axial movement relative to said housing,
reciprocatable means mounted in said housing for axial reciprocation relative to said housing, the reciprocatable means being balanced relative to said work-operating tool and
link means interconnecting said second drive means with said tool and with said reciprocatable means for reciprocating said tool and said reciprocatable means in opposite directions, said link means including a first eccentric having a first end mounted on said second gear for rotation with said gear and having a second end mechanically coupled to said work-operating tool and further including a second eccentric having a first end mounted on said third gear for rotation with said third gear and having a second end mechanically coupled to said reciprocatable means, one of the eccentrics being angularly offset through a particular distance relative to the other eccentric during the reciprocation of the work-operating tool and the reciprocatable means in opposite directions.

2. The machine of claim 1 wherein said tool and said reciprocatable means have the same weight and are disposed at substantially the same distance from the first drive means and wherein an air bearing is provided for controlling the lateral position of the housing relative to the shoe.

3. The machine of claim 2 wherein adjustable valve means are included for controlling the amount of air passing to the motor.

4. The machine of claim 1 wherein the shoe is disposed in a particular plane and the first and second eccentrics are disposed a substantially equal distance from the plane defined by the shoe.

5. A hand tool machine comprising
a housing having
a pair of opposite side walls,
a reciprocatable working member movable relative to said housing for action upon a workpiece to accomplish a predetermined result, said working member having
a pair of opposite side walls extending upwardly and spaced laterally a small distance from adjacent ones of said housing side walls, thus defining
narrow lateral passages communicating at their upper end with the atmosphere about said housing, and
means included in said housing for reciprocating said reciprocatable working member including
a rotary motor,
a gear train including
a first gear driven by said rotary motor and
second and third gears driven by said first gear in a balanced relationship,
first linkage means connected to and driven by said second gear in said gear train and connected to said reciprocatable working member for reciprocating said reciprocatable working member,
a member for providing a balance of forces with said reciprocatable working member during the reciprocating movement of said reciprocatable working member,
second linkage means connected to and driven by said third gear in said gear train for reciprocating said force-balancing member in a direction opposite to the reciprocating of said reciprocatable working member, and
means for directing air under pressure within said housing through said narrow lateral passages between said housing and said working member to the atmosphere for balancing the lateral position of said working member relative to said housing to prevent the working member from binding to the housing during the reciprocation of the working member.

6. A hand tool machine comprising
a reciprocatable working member for acting upon a workpiece to accomplish a predetermined result having
a pair of side walls disposed at opposite lateral ends of said member and extending along the edges thereof in the direction of reciprocatability, and
means for reciprocating said reciprocatable working member including
a housing having
a pair of side walls disposed at opposite lateral ends of said housing and extending upwardly and spaced laterally a small distance from said reciprocatable working member side walls, thus defining
narrow lateral passages communicating at their upper ends with the atmosphere about said housing,
a rotary motor disposed within said housing for rotation relative to said housing,
a gear train disposed within said housing and including
a first gear driven by said rotary motor and
second and third gears driven by said first gear in a balanced relationship, first linkage means disposed within said housing and connected to and driven by said second gear in said gear train and connected to said reciprocatable working member for reciprocating said reciprocatable working member in slidable relationship to said housing along said side walls of said housing and said working member, means disposed within said housing for providing a balance with said reciprocatable working member during the reciprocating movement of said reciprocatable working member, said balancing means being reciprocatably slidable within said housing, second linkage means connected to and driven by said third gear in said gear train for reciprocating said force-balancing means in a direction opposite to the reciprocation of said reciprocatable working member, and means for directing air under pressure within said housing through said narrow lateral passages between said housing and said reciprocatable working member to the atmosphere for balancing the lateral position of said reciprocatable working member relative to said housing to prevent the working member from binding to the housing during the reciprocation of said reciprocating means of said reciprocatable working member.

7. A hand tool machine comprising a housing having a pair of side walls disposed at opposite lateral ends of the housing, a pneumatic motor attached to said housing for rotation in said housing, means in said housing for selectively providing air under pressure to said motor for actuation thereof, a reciprocatable tool element movably mounted for reciprocation relative to said housing having a pair of side walls disposed at opposite lateral ends and extending upwardly and spaced laterally a small distance from said housing side walls, thus defining narrow lateral passages communicating at their upper ends with the atmosphere on the exterior of said housing, a reciprocatable weight movably mounted for reciprocation relative to said housing and having characteristics for balancing the reciprocating movements of said reciprocatable tool element, linkage means disposed in said housing and interconnecting said pneumatic motor, said reciprocatable tool element, and said reciprocatable weight to drive said tool element and said weight in opposite reciprocating directions, and means for directing air under pressure exhausting from said motor through said narrow lateral passages to the atmosphere for providing a fluid bearing laterally between said housing and said tool element to balance the lateral disposition of said reciprocatable tool element relative to said housing during the reciprocating movements of said tool element and said weight.

8. The machine of claim 7 wherein said linkage means comprises a first oscillatable link means eccentrically driven by said pneumatic motor and operatively connected to said tool element and a second oscillatable link means eccentrically driven by said pneumatic motor and operatively connected to said reciprocatable weight.

9. The machine of claim 8 wherein the first oscillatable link means are angularly offset through a particular angle with respect to the second oscillatable link means in any reciprocatory position of the reciprocatable tool element and the reciprocatable weight.

10. The machine of claim 7 including first, second and third gear means in said housing, the first gear means being driven by said pneumatic motor and driving the second and third gear means in a balanced relationship, said linkage means including a tool element link operatively connected to said tool element and eccentrically attached to said second gear means and a weight link operatively connected to said reciprocatable weight and eccentrically attached to said third gear means, the tool element link being angularly offset with respect to the weight link at any reciprocatory position of the reciprocatory tool element and the reciprocatable weight.

11. The machine of claim 10 wherein said first gear means has a smaller diameter than said second and third gear means and said second and third gear means have substantially identical diameters and have centers defining with the center of the first gear a line in the direction of reciprocation of the reciprocatable tool element and the reciprocatable weight.

12. The machine of claim 7 including means disposed in the housing for adjusting the amount of air introduced to the pneumatic motor per unit of time.

13. The machine of claim 10 wherein said reciprocating tool element has a work surface disposed in a particular plane, and wherein said first and second links are disposed substantially the same distance from a particular plane defined by said reciprocatable tool element.

14. The machine of claim 13 including adjustable means disposed in said housing for controlling the amount of air introduced to said pneumatic motor per unit of time.

15. A hand tool machine comprising a housing, a rotary motor mounted in said housing, drive means mounted in said housing and driven by said motor, first and second driven means mounted in said housing in a balanced relationship to the drive means and driven by said drive means, a reciprocatable tool element mounted relative to said housing to extend at least partially beyond the extremities of said housing and disposed for reciprocation relative to said housing, a reciprocatable force balancing element mounted in said housing for controlled reciprocation relative to said housing and having characteristics for balancing the reciprocation of said reciprocatable tool element, and means for reciprocating said tool element and said force balancing element in opposite directions at each instant of time, comprising first link means pivotally connected in said housing to said tool element and eccentrically and pivotally connected to said first driven means to reciprocate said tool element relative to said housing in accordance with the motion of said first driven means and second link means pivotally connected to said force balancing element and to said second driven means to reciprocate said force balancing element in accordance with the motion of said second driven means whereby said means are reciprocated in opposite directions, said first and second link means being disposed slightly offset angularly from each other in any reciprocatory position of the tool element and the balancing element.

16. The hand tool machine of claim 15 including means for passing compressed air from within said housing past said reciprocatable tool element in a direction to cool said reciprocatable tool element and to balance said reciprocatable tool element laterally relative to said housing.

17. The hand tool machine of claim 16 wherein said housing and said reciprocating tool element are constructed to provide for the passage of the compressed air in a vertical direction between said housing and said reciprocating tool element to produce an air bearing between said housing and said reciprocating tool element to balance said reciprocating tool element laterally relative to said housing.

18. The hand tool machine of claim 17 wherein said housing has vertical walls, and wherein said reciprocating tool element has vertical wall portions separated slightly from said housing to define passages, and wherein said air-passing means passes the compressed air through said passages to produce air bearings for balancing said reciprocating tool element laterally relative to said housing.

19. The hand tool machine of claim 17 wherein said housing is provided with tracks disposed at the sides of said housing and extending along the length of said housing, and wherein said first link means include a first element slidable along said tracks in a snug relationship with said housing and connected to said reciprocatable tool element to drive said tool element in the reciprocating relationship, and wherein said air-passing means operates to balance said first element laterally relative to said housing.

20. The hand tool of claim 17 including means for introducing air under pressure into said housing for movement through a path past said rotary motor to drive said rotary motor, and manually adjustable means disposed in the path of movement of the air under pressure for selectively controlling the rate at which air is introduced to said rotary motor.

21. A hand tool machine comprising a reciprocatable working member for acting upon a workpiece to accomplish a predetermined result, means for reciprocating said working member including a housing having first tracks disposed at the sides thereof and extending along substantially the length thereof and second tracks disposed therein and extending along at least a portion of the length thereof, a rotary motor disposed within said housing for rotation relative thereto, a gear train disposed within said housing and including a first gear driven by said rotary motor and second and third gears driven by said first gear in a balanced relationship, first linkage means disposed within said housing, connected to and driven by said second gear, and including a holding member connected to said working member and slidable in said first tracks for reciprocating said working member, means disposed within said housing for providing a balance with said working member during the reciprocation of the latter, said balancing means being slidable within said second tracks, second linkage means connected to and driven by said third gear for reciprocation of said second holding member in a direction opposite that of said working member, and means for pressurizing the interior of said housing and for balancing the lateral position of said working member by positioning said holding member laterally relative to said first tracks to prevent said holding member from binding relative to said housing during reciprocation of said working member.

22. The machine of claim 21 wherein said rotary motor comprises a pneumatically driven motor, said machine further including air passage means for delivering air to said motor and adjustable means in said air passage means for controlling the volume of air delivered to said motor per unit of time.

23. The hand tool set forth in claim 22 wherein said working member is provided with elements defining vertical passages relative to said first tracks and wherein said pressurizing means produce a flow of air under pressure through said vertical passages to provide for a lateral balancing of said working member during the reciprocation of said working member and said balance means.

24. A hand tool machine comprising a housing having a first set of tracks disposed at the sides and extending along the length thereof and a second set of tracks disposed within said housing and extending along the length thereof, a pneumatic motor attached to said housing for rotation therein, means in said housing for selectively providing air under pressure to said motor for actuation thereof, a reciprocatable tool element movably mounted for reciprocation relative to said housing, a reciprocatable weight movably mounted in said second set of tracks for reciprocation relative to said housing and having characteristics for balancing the reciprocating movement of said tool element, linkage means disposed in said housing and interconnecting said motor, said tool element, and said weight to drive said tool element and said weight in opposite reciprocating directions including a holding member connected to said tool element to cause the latter to be slidable relative to said first set of tracks and a second reciprocatable holding member connected to said weight to cause the latter to be slidable in said second set of tracks, and means for providing a fluid bearing between said tool element and said first set of tracks for balancing the lateral position of said tool element relative to said housing during the reciprocating movement of said tool element and to prevent said tool element from binding relative to said first set of tracks during such reciprocation.

25. The hand tool set forth in claim 24 wherein said first set of tracks are provided with vertical portions, and wherein means are included with said reciprocatable tool element for defining vertical passages with said vertical portions on said first set of tracks to provide for the production of fluid bearings in said vertical passages to laterally position said first reciprocatable holding member in said first set of tracks for preventing said first holding member from binding during the reciprocation of said first holding member in said first set of tracks.

* * * * *